US009822572B2

(12) United States Patent
Brown

(10) Patent No.: US 9,822,572 B2
(45) Date of Patent: Nov. 21, 2017

(54) FOOT-OPERATED DOOR OPENER

(71) Applicant: Vincent Stephenson Brown, Nashville, TN (US)

(72) Inventor: Vincent Stephenson Brown, Nashville, TN (US)

( * ) Notice: Subject to any disclaimer, the term of this patent is extended or adjusted under 35 U.S.C. 154(b) by 0 days.

(21) Appl. No.: 14/024,237

(22) Filed: Sep. 11, 2013

(65) Prior Publication Data

US 2014/0197648 A1 Jul. 17, 2014

Related U.S. Application Data

(63) Continuation-in-part of application No. 13/742,075, filed on Jan. 15, 2013, now abandoned.

(60) Provisional application No. 61/586,407, filed on Jan. 13, 2012.

(51) Int. Cl.
*E05B 3/00* (2006.01)
*E05F 11/54* (2006.01)

(52) U.S. Cl.
CPC ..... *E05F 11/54* (2013.01); *E05Y 2201/676* (2013.01); *E05Y 2800/00* (2013.01); *Y10T 292/57* (2015.04)

(58) Field of Classification Search
CPC ..... E05F 11/54; Y10T 292/19; Y10T 292/57
USPC ..... 292/336.3; 16/412, 413, 901; 49/274, 49/263, 356, 460
See application file for complete search history.

(56) References Cited

U.S. PATENT DOCUMENTS 2,737,408 A * 3/1956 Sperry ..... E05C 17/54 292/342
3,121,907 A * 2/1964 Stebbins ..... E05B 1/0053 16/225
3,391,674 A * 7/1968 Burleigh ..... A01K 1/035 119/174
4,044,424 A * 8/1977 Sasgen ..... E05C 17/54 16/85
4,068,872 A * 1/1978 Smith ..... E05B 53/001 292/255
4,569,546 A * 2/1986 Howard ..... E05B 53/001 292/225
4,621,848 A * 11/1986 Pierce ..... E05B 53/001 292/166
4,666,195 A * 5/1987 Thomas, III ..... E05C 17/443 292/336.3
4,710,634 A * 12/1987 Brookes ..... A61L 2/10 16/412
D296,189 S * 6/1988 Marx ..... D8/400
5,193,863 A * 3/1993 McBain ..... 292/255
5,469,661 A * 11/1995 Finkelstein ..... E05B 17/0033 49/235
5,983,454 A * 11/1999 Hartselle, III ..... E05B 1/0015 16/412

(Continued)

*Primary Examiner* — Kristina R Fulton
*Assistant Examiner* — Faria F Ahmad
(74) *Attorney, Agent, or Firm* — Raymond R. Ferrera; Adams and Reese LLP

(57) ABSTRACT

A foot-operated door opener including a base secured to a door and an extension having a top surface and a bottom surface, side surfaces and side edge surfaces. The foot-operated door is configured such that a door may be pulled open using either the top or bottom of a user's foot or foot covering. The side and side edge surfaces allow for operation in a confined space where the user needs to stand to the side of the door when operating.

5 Claims, 5 Drawing Sheets

(56) References Cited

U.S. PATENT DOCUMENTS

| | | | | |
|---|---|---|---|---|
| 6,189,183 | B1 * | 2/2001 | Hartselle, III | E05B 1/0015 16/412 |
| 6,360,488 | B1 * | 3/2002 | Darling | E05F 13/02 49/274 |
| 6,382,750 | B1 * | 5/2002 | King | A47B 95/00 16/901 |
| 7,043,799 | B2 * | 5/2006 | Moody | E05B 53/001 16/412 |
| 7,043,800 | B2 * | 5/2006 | Moody | E05B 53/001 16/412 |
| 7,270,352 | B1 * | 9/2007 | Stuart | 292/255 |
| 8,707,622 | B1 * | 4/2014 | Neustel, Jr. | 49/263 |
| 8,752,334 | B1 * | 6/2014 | Vanduch | E05B 53/001 16/422 |
| 9,115,530 | B2 * | 8/2015 | Michael | E05F 11/54 |
| 2004/0261226 | A1 * | 12/2004 | Moody | E05B 53/001 16/413 |
| 2005/0004502 | A1 * | 1/2005 | O'Mahony | A61M 1/3653 604/4.01 |
| 2005/0005402 | A1 * | 1/2005 | Moody | E05B 53/001 16/413 |
| 2009/0145037 | A1 * | 6/2009 | Michael | E05F 11/54 49/359 |
| 2013/0118085 | A1 * | 5/2013 | Hedemark | E05F 11/54 49/356 |
| 2014/0197648 | A1 * | 7/2014 | Brown | 292/336.3 |

* cited by examiner

FOOT-OPERATED DOOR OPENER

CROSS-REFERENCE TO RELATED APPLICATIONS

The present disclosure is a continuation-in-part of U.S. patent application Ser. No. 13/742,075, entitled "Foot-Operated Door Opener," filed on Jan. 15, 2013 which is expressly incorporated herein in its entirety by reference hereto.

FIELD OF THE INVENTION

The present invention relates generally to foot-operated door openers, and in particular though non-limiting embodiments, to foot-operated door openers that can be attached to a conventional door and enable a user to partially or fully open the door utilizing either the top or the bottom of the user's foot or shoe.

BACKGROUND

Hand and foot-operated door opening devices are known in the art. Foot-operated door opening devices that do not use a person's hand or arm (as opposed to conventional door knobs or handles) have existed in the art for over one-hundred (100) years. Early models involved simple hook screws mounted to the bottom of a screen door, enabling a user to pull the door open with the user's foot. Furthermore, early models were designed for use with a light screen door. Typically, the user would place his toe under the device to pull open the door.

More recent models are similar in design and function with a similar downward shaped hook or downward angled piece of material, but their sturdier design characteristics enable the opening of heavier doors. Foot-operated door openers provide sanitary benefits by enabling a user to open a door without hand contact with potentially germ and bacteria-contaminated door handles, particularly in public restrooms and other public spaces.

Previous attempts at foot-operated door openers included devices with shapes that would promote entanglement with shoe laces or clothing material like pant legs and cuffs due to the sharp downward angle of the hook for the toe to engage under or could trap a user's foot if the door was opened from the other side while the user was attempting to use the device.

Despite the efforts of the prior art, a need still exists for a sanitary foot-operated door opener with a design that enables the user to use not just the toe of his shoe to pull open a door, but also enables the user to use the bottom of his foot or shoe sole to push down on the sanitary foot-operated door opener in order to open a door. This is specifically necessary when an open-toe shoe or sandal or a delicate or ornamental shoe is worn in order to prevent damage to the shoe or injury to the toes.

Additionally, such an opener is desirable for persons with physical limitations that may not easily be able to pull upward with their toes due to medical-related foot or leg or lower body injuries. Furthermore, using one's toe when wearing an open-toe shoe or sandal would negate the sanitary aspect of the foot-operated door opener if one could not use the sole of his shoe instead.

There is, therefore, a long-standing yet unmet need for improved foot-operated door openers that overcome the deficiencies in the prior art.

SUMMARY

In exemplary embodiments, a foot-operated door opener is provided, including a single piece of material having a base portion and an extension portion. The base portion is configured to be attachable to a bottom of a door. The extension portion is configured to be engaged by at least one of a top surface of a foot covering and a bottom surface of the foot covering. The door opener is configured such that a user can pull open a door to which the opener is attached.

The single piece of material may be made from one of brass, stainless steel, aluminum, copper, plastic, composite, and carbon fiber or other durable material. The extension portion may be a wave shape. The extension portion may be shaped in a smooth arc. The extension portion may have a top surface and a bottom surface and side edge surfaces. The extension portion may be configured to be engaged at either the top surface or the bottom surface or either side edge surface.

DESCRIPTION

Figure 1:
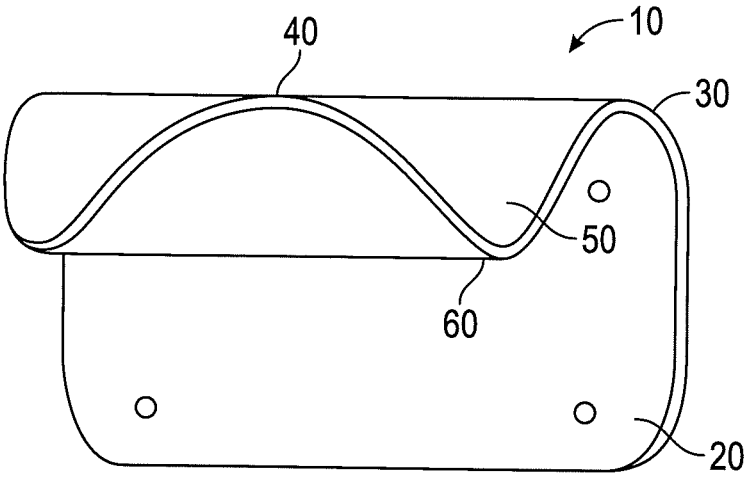
FIG. 1 illustrates a front view of a door opener according to example embodiments.

According to example embodiments, a sanitary and hands-free foot-operated door opener is provided that attaches to the bottom of an unlatched door of a range of widths, spring tensions, and door weights. According to example embodiments, the door opener enhances the sanitary nature of a standard foot-operated door opener by enabling the user to use the bottom of the user's foot or shoe sole as the contact point with the door. Certain embodiments enable the user to use a top surface of the user's foot or foot covering as the contact point with the door. According to other embodiments, the door opener's smooth and rounded design protects the user when the door to which the opener is attached is opened by a person on the other side of the door during operation of the foot-operated opening device. In still further embodiments, the smooth and rounded design prevents entanglement with the user's clothing or objects they might be carrying during use and leaves the user's shoe free if the door is opened from the other side. Furthermore, according to example embodiments, the design allows the foot-operated opening device to be used as a door stop to protect the wall when the door has been fully opened. In still further embodiments, the flexible design provides for leverage against the top or bottom of the user's shoe or foot. According to exemplary embodiments, the door opener is very easily installed, and relatively inexpensive to produce.

According to further embodiments, the door opener is attached to typical doors ranging from 24" to 36" in width, to heavier commercial doors or fire doors. According to example embodiments, this foot-operated door opener allows the user to initiate the opening of the door by using either the top of his foot or shoe, or by using the bottom of his foot or shoe sole. The ability to use either the top or bottom of the shoe or foot ensures compatibility and function with open or closed toe shoes and persons who may have physical limitations or injury to their feet or lower body. The ability to use the bottom of the shoe sole also allows operation by delicate shoes, and avoids damage to the top of the shoe surface.

According to still further embodiments, this foot-operated door opener enables the user to avoid hand contact with the door for sanitary reasons when opening the door. Other example embodiments provide hands-free opening for home or commercial use when a person has their hands full carrying items. Embodiments may be engaged not only from the top or bottom but also from either side which is beneficial in confined spaces and may be more comfortable for some users with physical or medical limitations. The side surfaces or side edge surfaces enable a user to pull a door open from a side angle to the door. This enables door opening in limited space situations when only partial reach is available. Having a side surface also enables the user to maintain voluntary contact with the device in order to hold the door open once it is pulled, if necessary.

According to example embodiments, the foot-operated door opener is made of strong durable material that has a pretension quality that allows the material to maintain the primary shape while still have a degree of flexibility. In further embodiments, the material is stainless steel, aluminum, brass, copper, or plastic. In still further embodiments, the material is a composite, such as carbon fiber or Kevlar.

In example embodiments, the foot-operated door opener is made from a single piece of durable material and is in the shape of a smooth wave that allows the foot or shoe to comfortably slide in and out and on and off of the opener without damage to the person's foot or shoe. In further embodiments, the overall side-to-side shape is in a smooth arc, extending from the door mounting. This shape prevents the user from being hindered during operation due to the catching of clothing or shoe laces or any similar item or object that the person may be carrying or wearing. In example embodiments, the foot-operated door opener easily mounts to the lower door surface area by use of screws or bolts fastened through the opener material utilizing pre-existing holes and into the door material.

According to example embodiments, the foot-operated door opener utilizes its unique curved design, along with the durable slightly flexible material to provide opposing tension to the user's bottom of his shoe or foot, or to the top of the user's shoe or foot, which naturally aids in keeping the door opener in contact with the user's foot during operation.

In still further embodiments, the foot-operated door opener serves as a door stopper when the door to which it is attached is fully opened, eliminating the need for a separate door stopping device to protect the wall.

Figure 2:
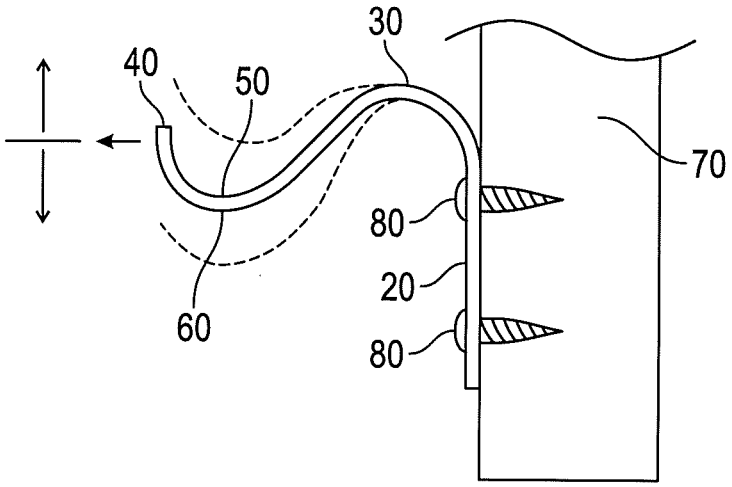
FIG. 2 illustrates a side view of a door opener mounted to a door according to example embodiments.
Figure 5:
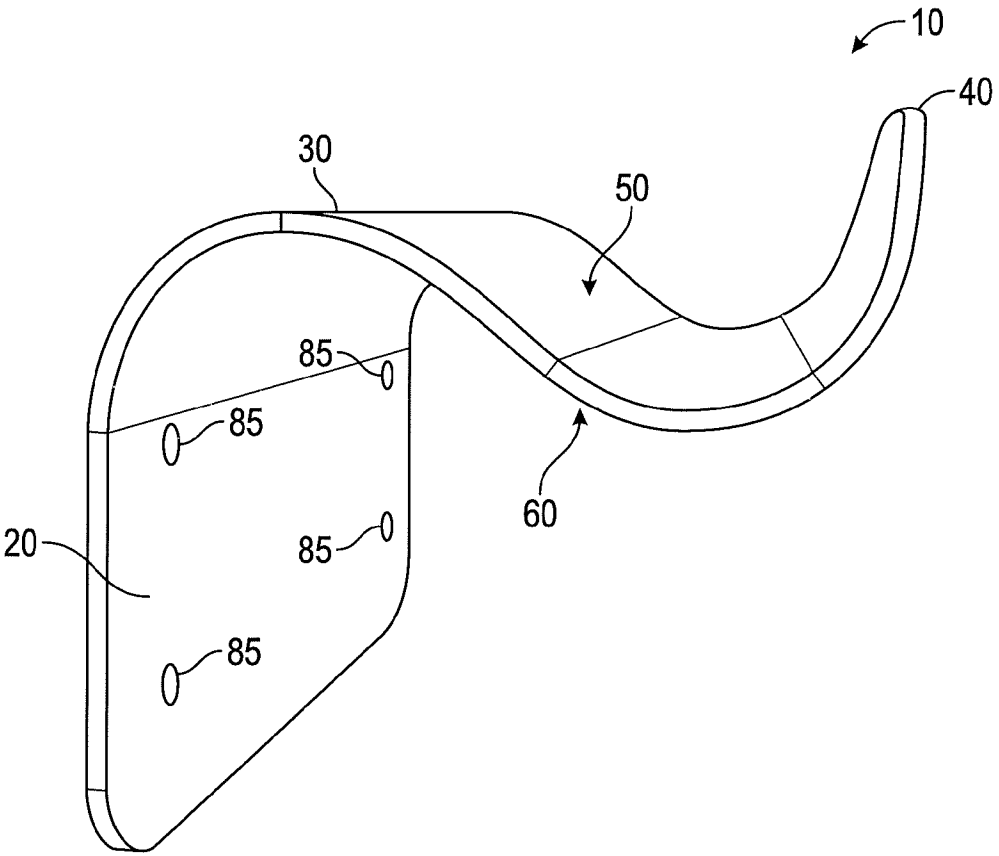
FIG. 5 is a side isometric view of a door opener according to example embodiments.

In FIGS. 1 and 5, an example embodiment of a door opener 10 is illustrated having a wave shaped extension 30 extending from a base portion 20. In base portion 20 a plurality of fastener apertures 85 are provided through which screws or similar attachment means may be passed to secure door opener 10 to a door. See, e.g. FIG. 2. Extension 30 has a top surface 50, a bottom surface 60, and a rounded end 40. Door opener 10 may be made of a durable material that allows for slight bending or displacement of extension 30 when a force is applied to the top surface 50 or bottom surface 60. See, e.g., FIG. 2.

Figure 3A:
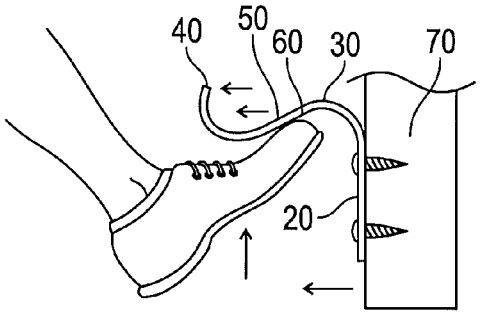
FIG. 3*a* illustrates a side view of a door opener in use, whereby the user utilizes the top of his foot to open the door, according to example embodiments.
Figure 3B:
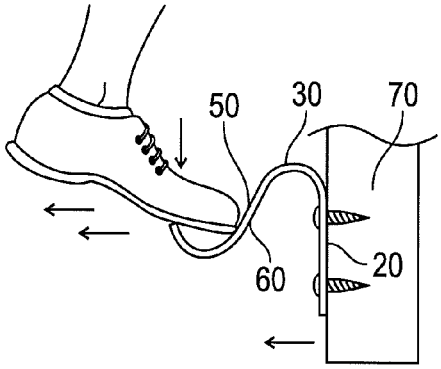
FIG. 3*b* illustrates a side view of a door opener in use, whereby the user utilizes the bottom of his foot to open the door, according to example embodiments.
Figure 3C:
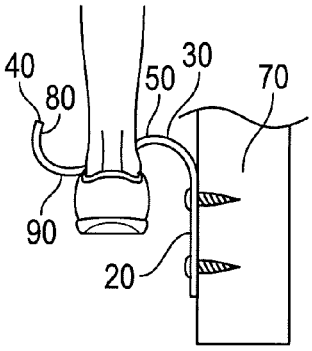
FIG. 3*c* illustrates a side view of a door opener in use, whereby the user utilizes the top of his foot to hold the door open, according to example embodiments.
Figure 3D:
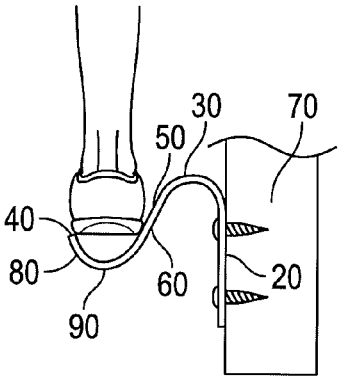
FIG. 3*d* illustrates a side view of a door opener in use, whereby the user utilizes the bottom of his foot to hold the door open, according to example embodiments.
Figure 4:
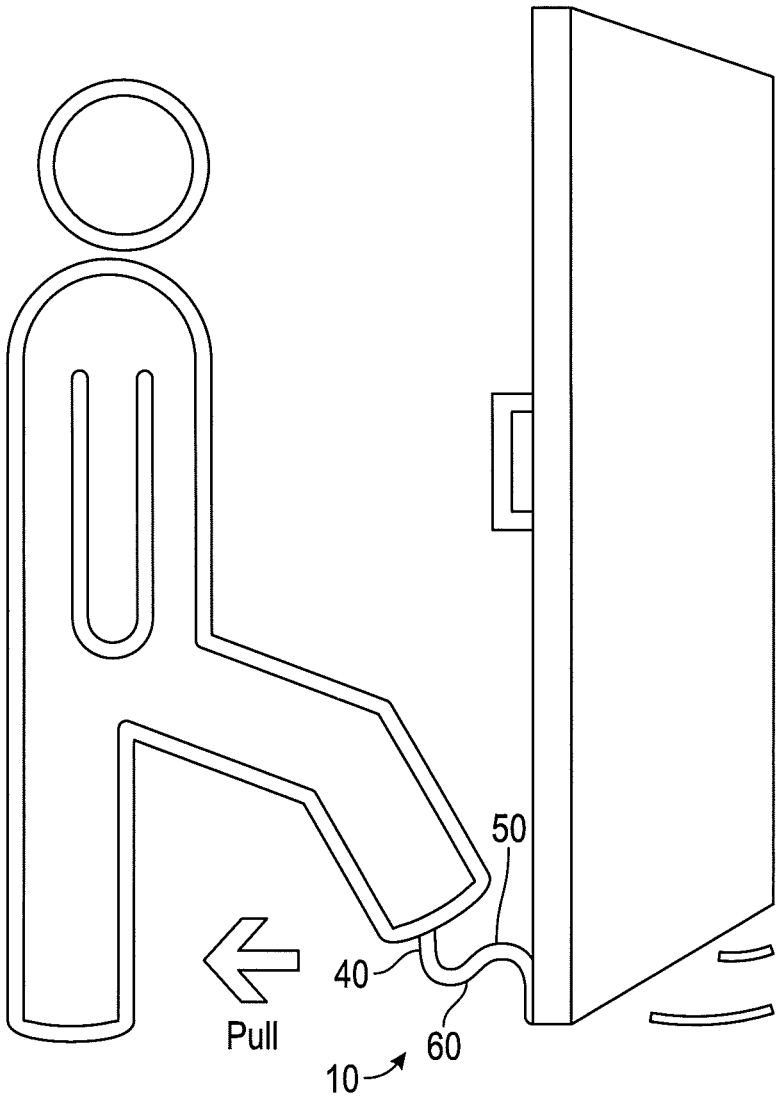
FIG. 4 illustrates a side view of a door opener in use according to example embodiments.

As shown in FIG. 3*a*, a user may use a top portion of the user's foot covering to engage bottom surface 60 and pull door 70 open. Alternatively, as shown in FIG. 3*b*, a user may use a bottom portion of a foot, covering, and/or outsole to engage top surface 50 and pull door 70 open. An illustration of a door being opened using a bottom surface of a user's foot or foot covering is shown in FIG. 4. Accordingly, embodiments of the present invention allow for comfortable use of door opener 10 when a user has on opened toed shoes or similar foot coverings that do not permit comfortable use of a top surface of the user's foot or foot covering. Embodiments may also have a first side surface 80 and a second side surface 90. First side surface 80 and second side surface 90 may be engaged by a side of a user's foot to either open door 70, or hold the door open after initially pulling it open. See, e.g., FIGS. 3*c* and 3*d*. Side edge surfaces 85 and 95 may be engaged by a user. Accordingly, embodiments may be engaged at top surface 50, bottom surface 60, end 40, first side surface 80, second side surface 90 or side edge surfaces 85 and 95.

Embodiments of the present invention may also provide enhanced utility for users with various medical conditions. Embodiments having contact or engagement surfaces both on top surface 50 and bottom surface 60 permit utilization by users with varying medical limitations. For example, a user having a hip impairment or limitation can comfortably engage top surface 50 with a bottom surface of the user's foot or shoe, relying primarily on the user's knee and hamstring to pull door 70 open. Alternatively, a user having various knee ailments that may prohibit or limit bending of the knee can use a top portion of the user's foot or shoe to engage bottom surface 60 with a straight leg to pull door 70 open.

In addition to the sanitary and medical benefits of the present invention, embodiments may be employed as hands-free openers where a user is prohibited from using the user's hands to engage a door handle. For example, in a restaurant setting, a server, with trays in the server's hands, may use embodiments to open doors without putting the trays down.

Figure 6A:
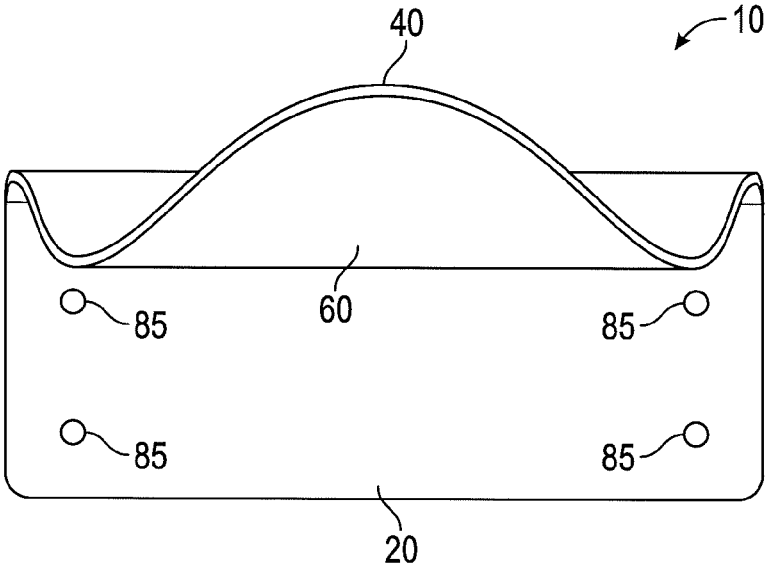
FIG. 6*a* is a front plan view of a door opener according to example embodiments.
Figure 6B:
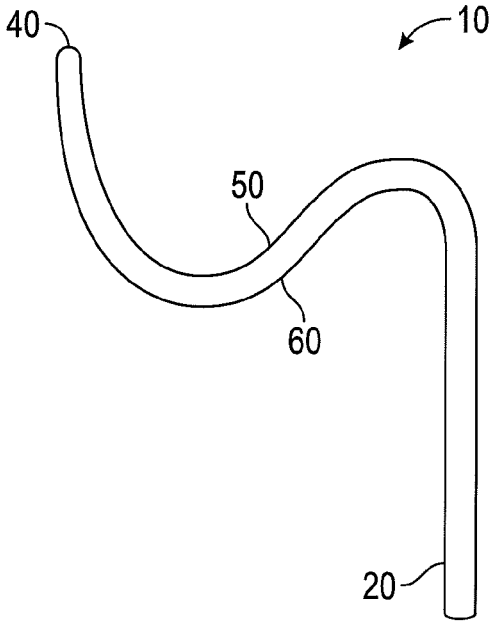
FIG. 6*b* is a side plan view of a door opener according to example embodiments.

In other example embodiments, the door opener may be of varying dimensions and the dimensions may be adjusted for a chosen door. FIGS. 6*a* and 6*b* illustrate dimensions of an example embodiment of the present invention having a wave shaped extension 30.

The foregoing specification is provided only for illustrative purposes, and is not intended to describe all possible aspects of the present invention. While the invention has herein been shown and described in detail with respect to several exemplary embodiments, those of ordinary skill in the art will appreciate that minor changes to the description, and various other modifications, omissions and additions may also be made without departing from the spirit or scope thereof.

What is claimed is:

1. A foot-operated door opener, comprising:

a single piece of material having a base member and an extension member;

wherein the base member is configured to be attachable to a bottom surface of a door; and wherein the extension member, which does not protrude below the bottom surface of the door, comprises a first portion arcing upwardly, a second portion arcing downwardly, and a third portion arcing upwardly, is configured to be engaged by either a bottom portion or a side portion of a user's shoe such that when either a downward or sideward force is applied by either a bottom portion or a side portion of said shoe, respectively, to said extension member, said door pulls open.

2. The door opener of claim 1, wherein the single piece of material is made from one of stainless steel, aluminum, copper, plastic, composite, and carbon fiber.

3. The door opener of claim 1, wherein the extension member further comprises a wave shape having top, bottom and side surfaces, each of said surfaces being of sufficient length and shape as to enable engagement from any angle.

4. The door opener of claim 1, wherein the extension member is configured to be engaged by the user's shoe at a top surface, a side surface, or a bottom surface of said extension member, wherein said top surface and said side surface each have a full 180° engagement surface that enables engagement by a user's shoe from any upper or side angle.

5. The door opener of claim 1, wherein the extension member is configured to be engaged by the user's shoe at a side surface of said extension member such that when a lateral force is applied to said side surface with said bottom portion of said shoe, said door pulls open, wherein said lateral or side engagement is enabled anywhere along a 180° engagement surface of the third portion of the extension member.

* * * * *